United States Patent [19]

Dady, Sr.

[11] Patent Number: 4,810,161

[45] Date of Patent: Mar. 7, 1989

[54] REACH ATTACHMENT

[75] Inventor: Kenneth J. Dady, Sr., Bellefontaine, Ohio

[73] Assignee: The Olofsson Corporation, Lansing, Mich.

[21] Appl. No.: 913,496

[22] Filed: Sep. 30, 1986

[51] Int. Cl.[4] ..... B66C 1/00

[52] U.S. Cl. ..... 414/700; 414/663; 414/733; 74/103

[58] Field of Search ..... 414/664–666, 414/668–670, 707, 710–713, 718, 917, 607, 608, 659–663, 700, 733, 706, 708, 715; 74/103; 173/38

[56] References Cited

U.S. PATENT DOCUMENTS

| | | | |
|---|---|---|---|
| 2,800,236 | 7/1957 | Schenkelberger | 414/661 |
| 2,829,785 | 4/1958 | Pitts | 414/541 |
| 3,018,011 | 1/1962 | Ackermann | 414/711 |
| 3,120,313 | 2/1964 | Ulinski | 414/710 |
| 3,184,086 | 5/1965 | Lull | 414/707 |
| 3,187,911 | 6/1965 | Christenson | 414/707 X |
| 3,211,314 | 10/1965 | Ulinski | 74/105 X |
| 3,387,836 | 5/1968 | Ulinski | 414/668 |
| 3,543,957 | 12/1970 | Russell | 414/707 X |
| 3,598,264 | 8/1974 | Massie | 414/664 |
| 3,750,490 | 8/1973 | Fisher | 414/733 X |
| 4,422,818 | 12/1983 | Molby | 414/712 |
| 4,441,852 | 4/1984 | Dixon | 414/733 |
| 4,451,196 | 5/1984 | Harada et al. | 414/733 |

FOREIGN PATENT DOCUMENTS

| | | | |
|---|---|---|---|
| 1174702 | 7/1964 | Fed. Rep. of Germany | 414/707 |
| 43104 | 10/1926 | Norway . | |
| 166440 | 1/1934 | Switzerland . | |
| 601154 | 4/1978 | U.S.S.R. | 414/917 |
| 1204556 | 1/1986 | U.S.S.R. | 414/659 |

*Primary Examiner*—Frank E. Werner
*Assistant Examiner*—Donald W. Underwood
*Attorney, Agent, or Firm*—Barnes, Kisselle, Raisch, Choate, Whittemore & Hulbert

[57] ABSTRACT

A reach mechanism for use on a material handling device having a load support carriage such as an industrial lift truck and a load carrier. The reach mechanism has a rear mount attachable to the carriage, a front mount for supporting lift forks or the like, and an extensible linkage for longitudinal projection and retraction of the front mount relative to the rear mount. The linkage includes two laterally spaced set of links, each set having a first pair of upper and lower links pivoted at the lower ends thereof to the rear mount at spaced points and a second pair of upper and lower links pivoted at the lower ends thereof to the front mount at spaced points. The upper end of each of the first and second pair upper links are pivotally connected to the upper end of the second and first pair lower links respectively. Hydraulic power rams actuate the links to project and retract the front mount. At least one upper link is constructed in at least two pieces for articulation thereof between its upper and lower ends about a pivot connection intermediate the ends. The intermediate pivot connection is controlled so as to move through a predetermined path of travel which varies the effective length of the one upper link to cause the minimization of the non-travel transverse and/or tilting movement of the front mount.

8 Claims, 4 Drawing Sheets

FIG. 1
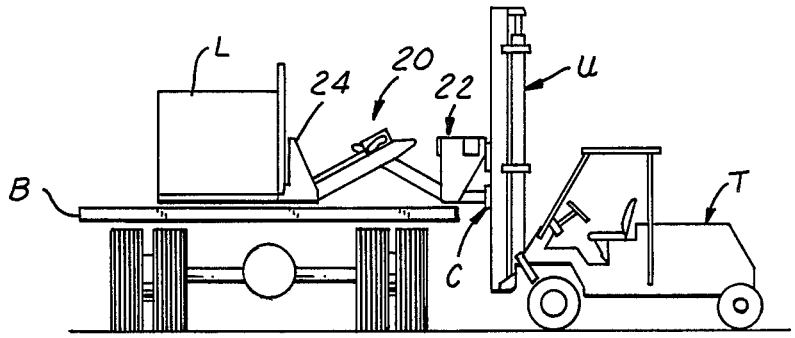
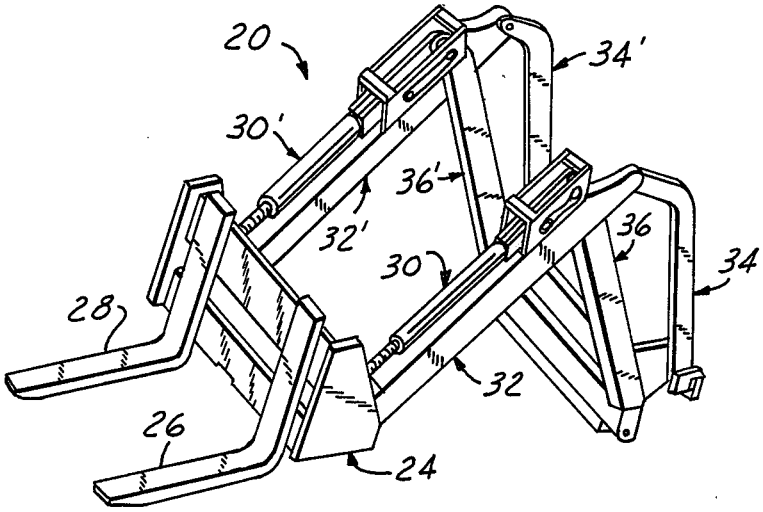
FIG. 2
FIG. 3
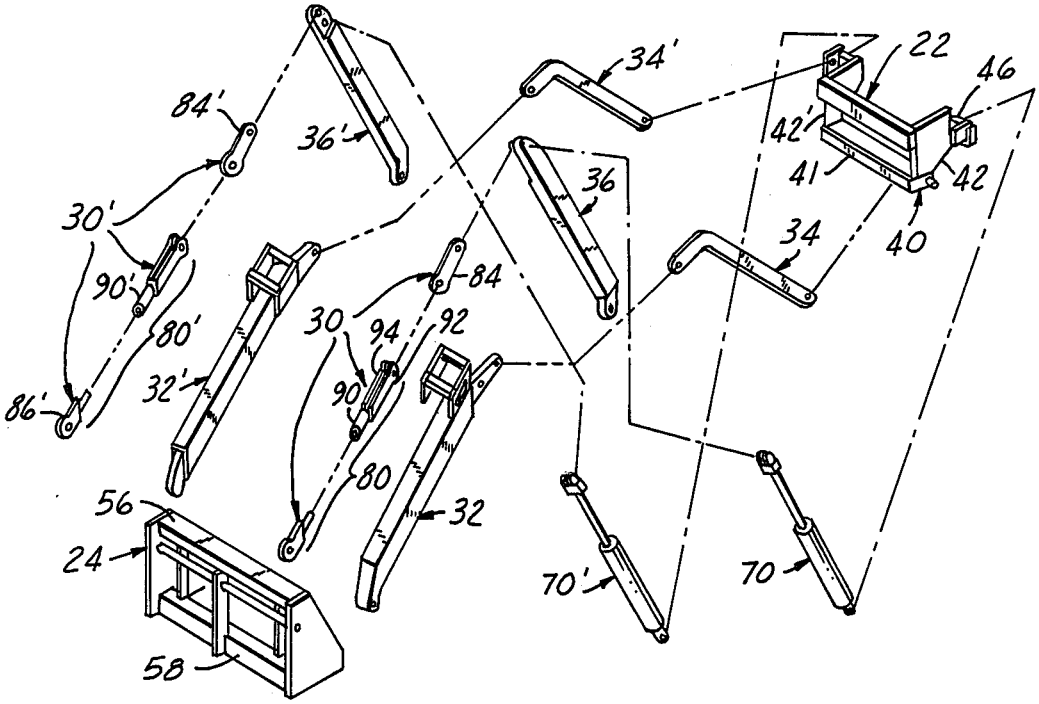

REACH ATTACHMENT

This invention relates to load-handling apparatus, and more particularly to such apparatus which features load-holding structure mounted, through extensible reach mechanism, on a support frame.

As exemplified by the preferred embodiment of the invention herein disclosed, such load-handling apparatus may take the form of an attachment for an industrial lift truck, where reach mechanism is included to permit the load-holding structure to be extended out from the vehicle to pick-up and deposit loads at locations that otherwise would be inaccessible. Such reach attachments are also employed on so-called "Shooting Boom" off-the-road material handling vehicles as well as on wheel loader vehicles, such as front loaders and the like.

For reasons of safety, increased maneuverability, and to obtain optimum load distribution while transporting a load, such reach mechanisms are contracted to bring the load-holding structure adjacent the usual mast assembly on the lift truck when the lift truck is traveling from one location to another. The same applies to the aforementioned "Shooting Boom" and wheel loader applications. Such mechanisms for projecting a load carriage or load forks are very old in the art and numerous patents, including the following United States and foreign patents, are illustrative of the development and state of this art:

| U.S. Pat. No. | Date | Inventor |
|---|---|---|
| 308,118 | 1884 | Whitcomb |
| 2,334,323 | 1943 | Gilbert |
| 2,501,112 | 1950 | Webster |
| 2,616,578 | 1952 | Dunham |
| 2,701,657 | 1955 | Sherman |
| 2,752,058 | 1956 | Gibson |
| 2,767,869 | 1956 | Miller |
| 2,785,807 | 1957 | Prowinsky |
| 2,786,723 | 1957 | Harsch |
| 2,800,236 | 1957 | Schenkelberger |
| 2,829,785 | 1958 | Pitts |
| 2,973,878 | 1961 | Gibson |
| 2,975,923 | 1961 | Ulinski |
| 2,990,072 | 1961 | Mindrum |
| 2,992,751 | 1961 | Quayle |
| 3,034,675 | 1962 | Quayle |
| 3,048,293 | 1962 | Cushman |
| 3,082,894 | 1963 | Gibson |
| 3,142,400 | 1964 | Garnich |
| 3,162,317 | 1964 | Becker |
| 3,204,720 | 1965 | Eitel |
| 3,211,314 | 1965 | Ulinski |
| 3,261,485 | 1966 | Anderson |
| 3,270,899 | 1966 | Brown et al |
| 3,327,879 | 1967 | Lull |
| 3,381,834 | 1968 | Gibson |
| 3,381,836 | 1968 | Ulinski |
| 3,414,150 | 1968 | Ulinski |
| 3,528,579 | 1970 | Ulinski |
| 3,542,227 | 1970 | Farmer et al |
| 3,567,055 | 1971 | Serge |
| 3,675,803 | 1972 | Baughman |
| 3,700,132 | 1972 | Waters |
| 3,836,025 | 1974 | Olson et al |
| 3,937,339 | 1976 | Geis et al |
| 3,985,248 | 1976 | Liegel et al |
| 4,034,875 | 1977 | Pugh et al |
| 4,042,135 | 1977 | Pugh et al |
| 4,082,197 | 1978 | Stedman |
| 4,133,411 | 1979 | Curb |
| 4,147,263 | 1979 | Frederick et al |
| RE 30,021 | 1979 | Olson et al |
| 4,274,794 | 1981 | Olson |
| 4,382,743 | 1983 | Newell |

-continued

| | | |
|---|---|---|
| 4,413,708 | 1983 | Stedman |
| 4,458,780 | 1984 | Telfer |
| 4,482,286 | 1984 | Farmer et al |
| 4,498,837 | 1985 | Kooi et al |
| 4,505,635 | 1985 | Shinoda et al |
| 4,583,907 | 1986 | Wimberley |
| Foreign Patents | | |
| 43,104 | Norway | |
| 166,440 | Switzerland | |

With respect to the aforementioned prior art, U.S. Pat. Nos. 3,211,314 and 3,381,836 to Ulinski are of particular interest. These patents disclose projecting and contracting lift truck reach attachment constructions utilizing two pairs of links, with one pair of links pivoted to the lifting carriage of the truck and the other pair of links pivoted to the load platform or load forks. As stated in these patents, this type of reach attachment obtains a very considerable projection of the load forks while at the same time providing a relatively low overall height of the links when the links holding the forks are fully retracted. The Ulinski arrangements thus avoid one of the difficulties of the prior art scissors linkage reach arrangements in which the links have a high overall height when holding the forks retracted. The Ulinski type reach attachments also are advantageous in eliminating the sliding mechanisms of the scissors linkage, which reduces friction and contributes very considerably to rigidity, thereby eliminating rattling and noise of the reach attachment when the load carrier vehicle is traveling with the linkage in retracted position.

Although it is stated in the Ulinski U.S. Pat. No. 3,211,314 that the reach attachment mechanism disclosed therein contributes substantially level projection of the load forks during extension and retraction thereof nevertheless it has been found that there remains inherent in the disclosed mechanism the considerable disadvantage that the front mount or load carrying forks will tilt through a 5° or so range in a typical 48 inch reach extension because of the changing tilt attitude of the pivots 22 and 23 during extension and retraction of the Ulinski reach attachment. Moreover, it has been found that the front lower pivot 23 will rise and fall in a vertical direction an undesirable amount during extension and retraction. When these two motions are compounded by a typical further forward projection of say four feet to the front tips the lift forks, the same may move as much as 4 or 5 inches vertically in a typical application. It is very difficult and unsafe to attempt to compensate for such fork tip movement by the vehicle operator raising and lowering the entire reach attachment so that the fork tips travel in a relatively level plane particularly when the fork tips are highly elevated by the lift carriage on the lift truck mast.

Accordingly, a general object of the present invention is to provide an improved load handling apparatus which obtains the advantage of the reach attachment set forth in the aforementioned Ulinski U.S. Pat. No. 3,211,314, including a relatively low overall height of the links when the links hold the forks retracted, and increased rigidity and reduction in noise of the mechanism when vibrated during travel in the retracted condition, while also overcoming the aforementioned tilting and/or vertical travel movement of the lift forks or other load carrying member during extension and retraction of the reach attachment.

Another object is to provide a novel extensible reach mechanism of the aforementioned character which is simple and reliable in construction, economical to manufacture, readily adjustable during set-up and readjustable during its life, and well adapted for use on a variety of load lifting vehicles.

Other objects, features and advantages of the present invention will become apparent from the following detailed description, as well as from the appended claims, taken in conjunction with the accompanying drawings, wherein:

FIG. 1 is a side elevational view of a industrial lift truck having an extensible load lifting mast mounted thereon, with a reach attachment embodiment of the present invention carried on the load lifting carriage, and shown in extended or projected position with a load disposed over the flat bed of a truck trailer.

FIG. 2 is a somewhat simplified perspective view of one embodiment of the improved reach attachment of the present invention, shown by itself, with load lifting forks carried on the front mount of the reach attachment.

FIG. 3 is a simplified exploded perspective view of the reach attachment of FIG. 2, and also shown in conjunction with a rear mount structure particularly adapted for mounting on the end of the shooting boom load lifter.

DESCRIPTION

Figure 4:
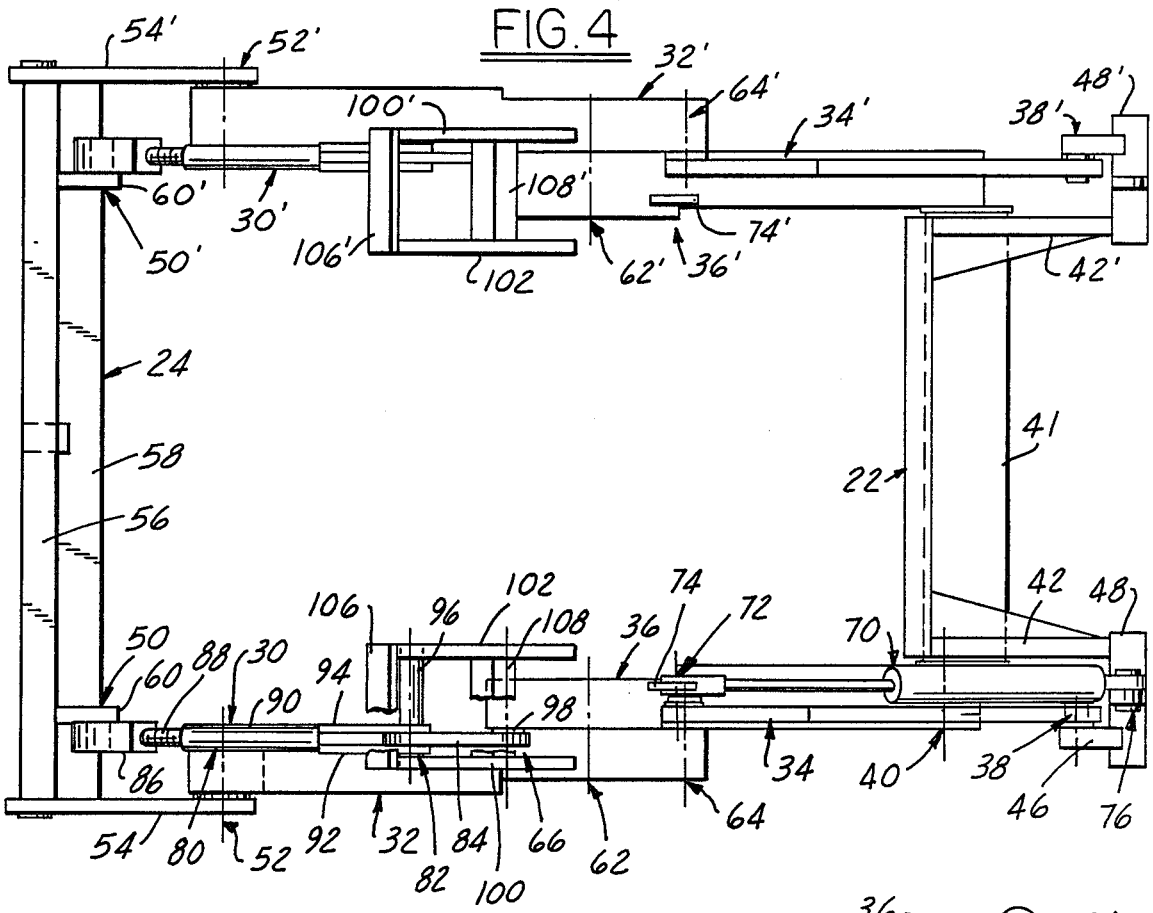
FIG. 4 is a top plan view of the reach attachment in FIGS. 1, 2 and 3, shown in fully projected or extended condition on the rear mount structure of FIG. 3.

Referring to the drawings, a load projecting and retracting mechanism, and more particularly an improved fork reach attachment, constructed in accordance with the present invention, is generally designated by the numeral 20 in FIGS. 1, 2 and 3. In FIG. 1 the fork reach mechanism lift 20 is shown mounted on the lifting carriage C of a conventional industrial truck T. The lift carriage C, in turn, is mounted for vertical movement on upright U of the truck, whereby reach attachment 20 may be raised and lowered in a conventional manner. The fork truck T, carriage C and uprights U, which form the lifting mechanism for reach attachment 20, form no part of the present invention per se and accordingly will not be described in detail.

Referring in more detail to FIGS. 2, 3, 4 and 5, the fork reach mechanism 20 includes generally a rear mount structure 22 attachable to the load support of the material handling device, such as the carriage C of lift truck T. Reach 20 also includes a front mount structure 24 adapted to carry a load engaging member, which as shown in the drawings may be in the form of lift forks 26 and 28 (FIGS. 1 and 2) the tines of which can be inserted through a pallet for transporting a load L such as shown in FIG. 1, wherein the reach mechanism is shown in fully projected or extended position to place the load L on the side of a truck trailer bed B remote from the lift truck T. Front mount 24 is attached at each side (port and starboard) to the rear mount 22 by identical linkage systems which support the front mount for projecting and retracting movement relatively to the rear mount 22. Each of the linkage systems is formed of two sets of links including front upper and lower links 30 and 32 rear upper and lower links 34 and 36 respectively. Since the linkage sets on the starboard side of the reach mechanism are identical to those just described on the port side, duplicate numbers raised by a prime suffix have been used to identify the starboard linkage mechanism, and the same not further separately described except where deemed necessary for clarity.

Figure 5:
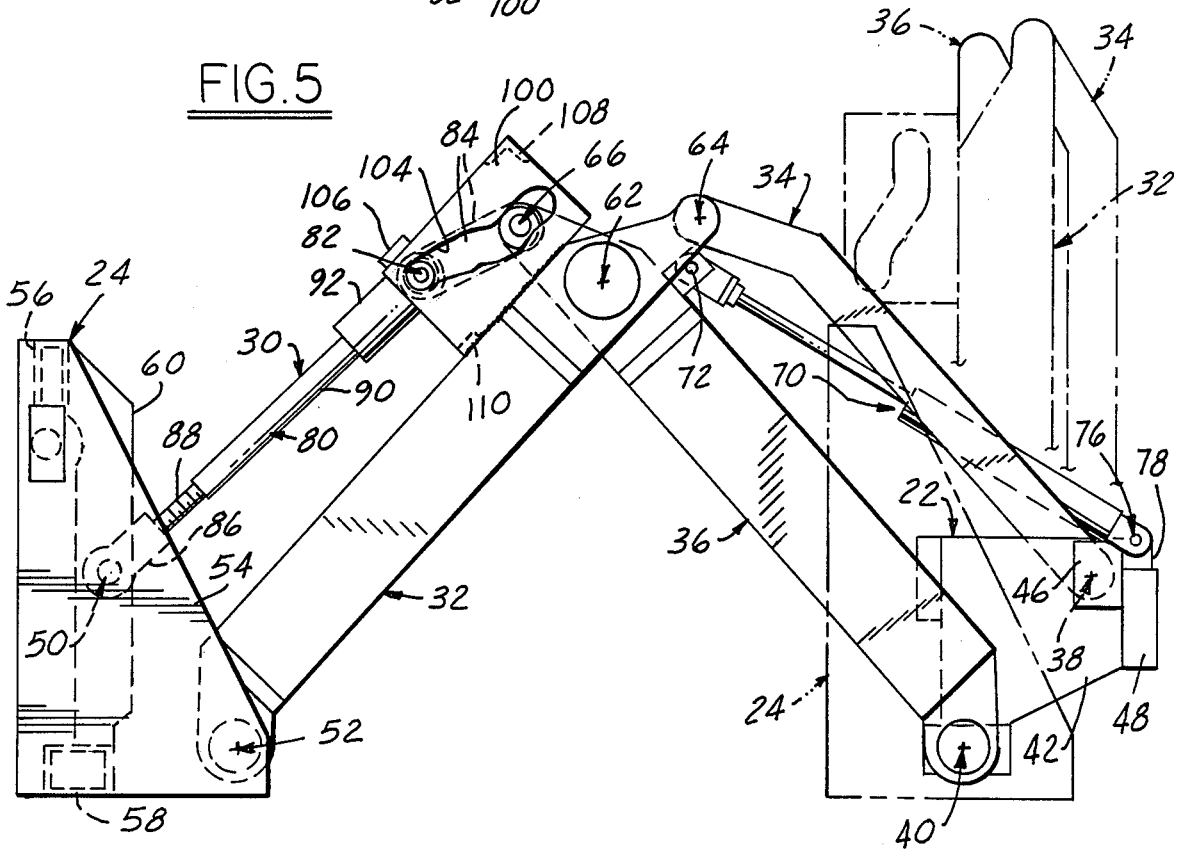
FIG. 5 is a side elevational view of the reach attachment of FIGS. 1–4, shown in fully extended position.

The rear upper and lower links 34 and 36 are pivotally attached by means of upper and lower horizontal pivots 38 and 40 to rear mount 22. (The term "pivot(s)" as used herein designates conventional pivot bearing structure such as pins, bushings, studs, washers, retainers, sleeves, bearings, etc. which are not described for purposes of brevity) Pivot 40 is secured to a cross bar 41 of rear mount 22 which in turn extends between upright side plates 42 and 42′ of the rear mount 22. Pivot 38 is supported by bracket 46 affixed to a short support rail section 48 which in turn is welded to plate 42 (FIGS. 3 and 4). The front set of upper and lower links 30 and 32 are pivotally attached by means of upper and lower horizontal pivots 50 and 52 front mount or load platform 24. As best seen in FIGS. 4 and 5, front mount 24 has a pair of laterally spaced, upright side plates 54, 54′ interconnected by and welded to upper and lower horizontally extending cross braces 56 and 58. Pivot 52 is secured to the lower rear corner of plate 54, and pivot 50 is secured to an upright strut 60 welded to cross struts 56 and 58.

The front and rear lower links 32 and 36 are pivotally attached together by a transverse horizontal pivot 62 at a point near the upper ends of these arms or links. The front lower link 32 is pivotally attached at its upper end by pivot 64 to the upper end of rear link 34. The upper end of rear lower link 36 is pivotally connected to front upper link 30 by a pivot 66.

A pair of hydraulic rams 70 and 70′ are pivotally attached each at its upper end by means of a pivot 72 to a bracket 74 welded to the upper side of lower rear link 36. The lower end of ram 70 is pivotally attached by means of a pivot 76 to a bracket 78 welded to the upper side of short rail 48 of rear mount 24. The rams could be mounted differently, just so one end is connected relative to rear lower arm 36 and one end connected relative to rear support frame 22, or they could be reversed by mounting front support frame 24 to front lower arms 32.

With this arrangement, if the links are in their retracted position as shown in phantom in FIG. 5, rams 70, are in their fully contracted condition. If these rams are then hydraulically powered to extend through an expansion stroke, by way of admission of hydraulic fluid under pressure to the ram by operation of a suitable control valve normally provided on the load vehicle T (as will be well understood in the art), front mount 24, with whatever load platform may be attached thereto, such as the lift truck forks 26 and 28, will be projected in a substantially straight line path (horizontally as viewed in FIG. 5) through the unfolding of upper and lower front and rear links 30, 32, 34, 36. The full extension condition of the links and the fully projected position of the front mount 24 is shown in solid lines in FIGS. 4 and 5. If the rams 70, 70' are thereafter contracted (the same being conventional double-acting power cylinders) front mount 24 with the associated load platform will be retracted in a substantially straight line path through folding of the links. Thus, through operation of the rams 70, 70', front mount 24 and the associated load platform may be retracted or projected to any degree to facilitate engagement of the platform with a load, or to facilitate depositing of a load supported on the platform in a particular spot. As in the prior art Ulinski U.S. Pat. No. 3,211,314 reach attachment mechanism, the linkage system of the invention provides for considerable projection of the load platform (for example 48" in one working embodiment), and yet has a relatively low overall height, even when the load platform is retracted, as shown in phantom in FIG. 5.

In accordance with one principal novel feature of the present invention, stabilizing means are constructed and arranged for automatically varying the effective length of one or both of the front and rear upper links 30, 34 during travel of the front mount 24 between its projected and retracted positions such that tilting movement of the front mount about an axis perpendicular to its direction of travel is minimized during such travel, and/or vertical travel (or in a direction perpendicular to the extension travel direction) is reduced to a minimum. The term "effective length" means the straight line or shortest distance measured between the end of the links containing the stabilizing means. Anti-tilt control is accomplished in the embodiment of FIGS. 1 through 7 by constructing the upper front link 30 in at least two rigid sections or pieces 80 and 84 with articulation therebetween about a pivot connection 82 located between the ends of upper link 30, and then providing means for controlling movement of intermediate pivot connection 82 through a predetermined path of travel toward and away from link arm 32 which is operative to vary the effective length of link 30 in a predetermined manner to effect minimization or zero-out of tilting movement of the front mount 24.

As best seen in FIGS. 3, 4 and 5, the front piece of link 30 comprises a tube and threaded rod assembly 80 forming an adjustment turn buckle extending between pivot point 50 and a pivot connection 82 with the front end of a short link 84, which in turn is pivoted at 66 to the upper end of rear lower arm 36. Turn buckle assembly 80 consists of a pull arm base member 86 journalled on pivot 50 and having affixed thereto a threaded rod 88 on which a tube 90 is received. Tube 90 at its upper end has affixed thereto a pair of parallel clevis plates 92 and 94 which are provided with coaxially aligned apertures at their upper ends to receive a cam track roller 96 therethrough. The lower end of link 84 is is inserted between the upper ends of clevis plates 92 and 94 and is apertured to receive cam roller 96 therethrough to form the pivot structure 82. The upper end of link 84 is apertured to receive a pivot pin 98 mounted on the upper end of rear lower arm 36 to form the pivot connection 66. It thus will be seen that as pivot point 82 swings in an arc about pivot 66 (and pivot 50) the effective length of front upper link 30 between pivots 50 and 66 will vary from a maximum length when all three pivots 50, 82 and 66 are aligned to a minimum length where pivot 82 is offset a maximum distance away from an imaginary line drawn between pivots 50 and 66.

In order to control the aforementioned movement of pivot 82 for varying the effective length of upper link 30, cam track means are affixed to the front lower arm 32. As best seen in FIGS. 3, 4 and 5, such cam means includes a pair of cam track plates 100, 102 disposed parallel to one another and to the longitudinal axis of arm 32, outboard plates 100 being fixed directly, and inboard plate 102 indirectly, to the upper surface of front lower link 32 near pivot 62. Plates 100 and 102 each have a cam track 104 cut therethrough adapted to provide roller guiding engagement, with suitable slide and/or roller clearance, with cam roller pin 96 of pivot 82. Pin 96 extends at its opposite ends into and through each of the cam tracks 104 of plates 100 and 102 so as to confine and control, in a predetermined manner, the travel of pivot 82 during extension and retraction of reach mechanism 20. The predetermined profile of the opposite parallel edges **104*a* and 104*b* (FIG. 6) of track 104 thus moves pivot 82 relative to front lower arm 32 to vary the distance therebetween as a function of reach extension and retraction so as to vary the effective length of link 30. This predetermined variation offsets or compensates for the tendency front mount 24 to otherwise tilt back and forth about an axis of rotational movement perpendicular to the extension travel path . As a consequence the front tips of forks 26 and 28** do not move (tip up and/or down) as they are carried through the extension-retraction strokes, which, as indicated previously, has been ascertained to be a problem with the aforementioned Ulinski '314 patent mechanism.

Figure 6:
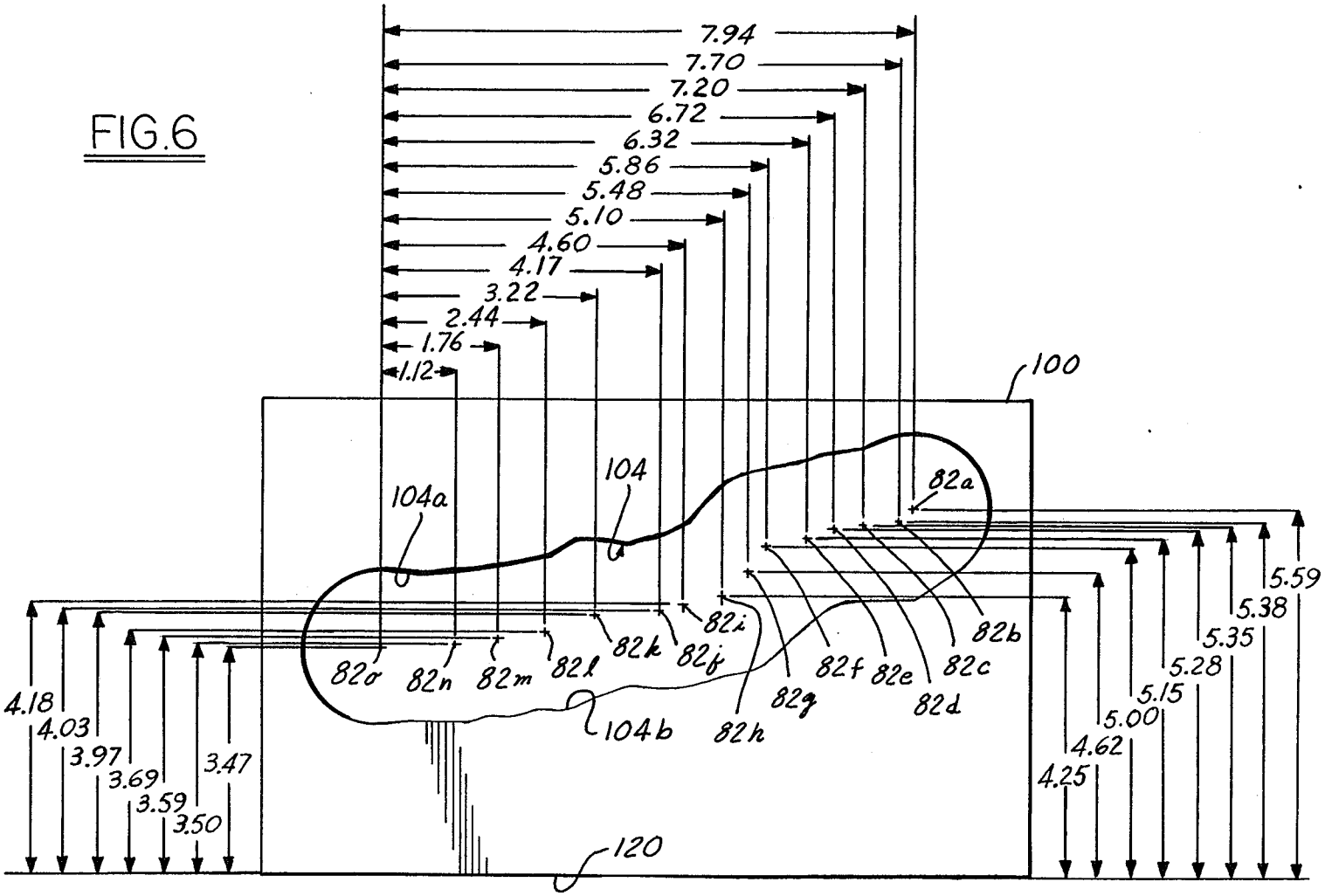
FIG. 6 is a side elevational view of the cam track control means of the embodiment of FIGS. 1 through 5 with a plot of the axis of the cam track roller shown in the center of the cam track, dimensions being applied thereto illustrative of one working embodiment of the present invention.

Referring in more detail to FIGS. 4, 5 and 6, the associated structure of cam plates 100 and 102 includes a top strut 106 extending across and affixed to the upper edges of plates 100 and 102 near the lower or front end thereof, as well as a reinforcing right angle strut 108 extending between and affixed its ends to the interior surfaces of plates 100 and 102 near the upper rear corner thereof. Another cross strut 110 extends between and is affixed at its ends to the interior surfaces of plates 100 and 102 near the front lower corners thereof. Outboard plate 100 is affixed as by welding directly to the upper surface of front lower arm 32 along its lower edge as can be strut 110, and the cross struts 106, 108 and 110 form a block frame with plate 102 to support the same in cantilever fashion from front lower arm 32. The load stresses exerted on cam roller pin 96 thus are taken by both plates 100 and 102 and distributed therebetween to relieve the bearing loads on pivot 82 and the associated cam roller pin 96.

Figure 7:
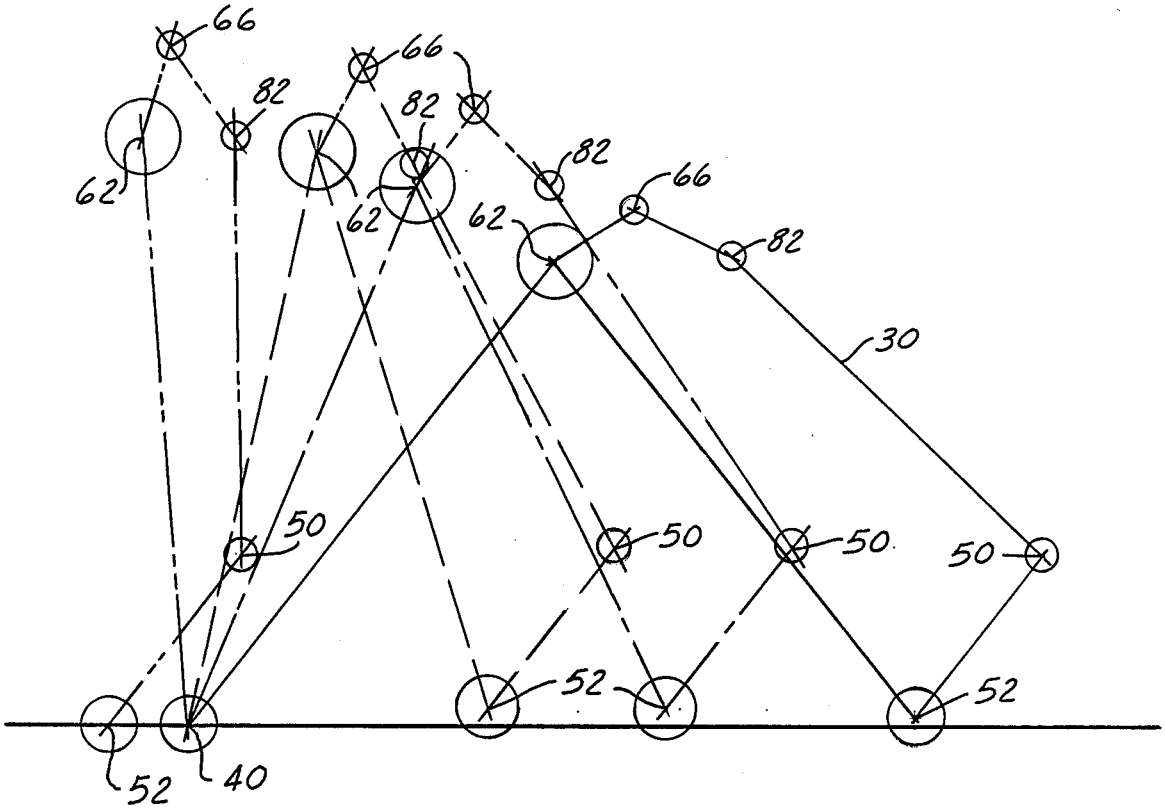
FIG. 7 is a schematic diagram of certain elements of the linkage mechanism of the embodiment of FIGS. 1–6 shown in four positions of the linkage between fully retracted and fully projected conditions thereof.

The development of the appropriate profile of cam track 104 is set forth more particularly with reference to FIGS. 6 and 7. Referring to FIG. 6, the same illustrates in side elevation, but reversed relative to FIG. 5 and on an enlarged scale thereover, cam plate 100, cam plate 102 being identical thereto. It is to be understood that plate 100 is a true rectangle for purposes of this layout, although of course the outline configuration of the plate may vary. This view illustrates one method in accordance with the invention of establishing the contour or profile of the cam track 104 by plotting reference dimensions from the lower edge 120 of plate 100 and from pivot point 82 in its fully retracted position. The position of the axis or pivot 82 in the fully extended position of the linkage as shown in FIG. 5 corresponds to point **82*a* in FIG. 6. The position of axis 82 in the fully collapsed or retracted condition of the linkage, corresponding with the phantom illustration thereof in FIG. 5, is labeled 82*o* in FIG. 6. The remaining intervening sequential plot points of pivot 82 are labeled 82*b* through 82*n*. The upper and lower edges 104*a* and 104*b* of cam track 104 are plotted by laying out a best fit curve to the plot points and then moving a circle, having the diameter of the cam roller 96, with its axis along the plot point curve. The dimensions as shown in FIG. 6 are actual working dimensions of one working embodiment of the invention constructed with a total reach of 48** inches between projected and retracted positions. This dimension can be applied to the illustration in FIG. 5, which is to scale, to assist in practicing of the present invention pursuant to the present disclosure. In this working embodiment, the following dimensions and relationships have been employed:

| Distance between enumerated pivot points | Inches |
|---|---|
| 52 to 62 | 36.0 |
| 62 to 40 | 36.0 |
| 50 to 82 | 26.75 |
| 82 to 66 | 7.12 |
| 66 to 62 | 6.06 |
| 62 to 64 | 7.00 |
| 64 to 38 | 32.5 |
| 38 to 40 | 13.03 |
| 50 to 52 | 13.03 |
| Angle of line through points 50 and 52 relative to line H | 52°-38' |
| Angle of line through points 38 and 40 relative to line H | 52°-38' |

Referring to FIG. 7, the same is a schematic layout of the certain of the pivot points of the linkage in four positions thereof, the position at the left (as viewed in FIG. 7) being the fully retracted position and the right hand position being the fully projected or extended position of the linkage. Although FIG. 7 only shows four different positions of the linkage, typically in plotting the cam track profile 104 the path of travel is divided into some 15 to 17 increments for layout purposes, if a manual layout method of plotting is employed. Of course, computer aided design programs modeled to follow the principles of the present invention will simplify this process, as will be understood in the art.

As will be seen from FIG. 7, the angle described between an imaginary line drawn through front mount pivot points 50 and 52 relative to the horizontal base line H is kept essentially constant, the same being in this working embodiment about 37° 22 minutes with respect to a vertical line drawn perpendicular to the base line H. Pivot point 40 is held constant as pivot points 50 and 52 are moved from their retracted position at the left hand side of FIG. 7 to the fully extended position at the right hand side of FIG. 7. Pivot points 62 and 66 thus swing through an arc of constant radius from fixed pivot 40. The articulated front link 30 is allowed to flex about its end pivots 66 and 50 to move its intermediate pivot point 82 as necessary to accommodate the zero tilt condition of points 50 and 52 relative to data line H to thereby derive the cam plot layout, as will be well understood by those skilled in the art based on the aforegoing description and drawings. For example in the above working embodiment an arc having a radius of 7.12" is struck from point 66 as a center for each linkage position, and an arc having a radius of 26.75" is struck from point 0.50 as a center for each such linkage position, and the intersections of these two arcs will define the location of pivot 82 for each such linkage position.

Figure 8:
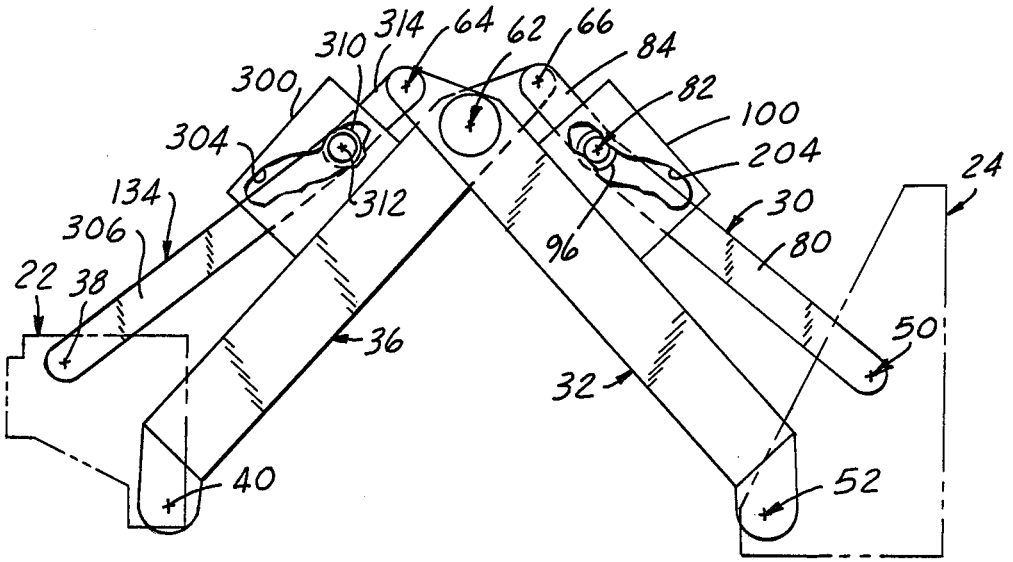
FIG. 8 is a semi-schematic elevational view of a further embodiment of a reach attachment mechanism also constructed in accordance with the present invention.

Referring now to FIG. 8, a modified embodiment of the invention is shown in semi-schematic simplified form wherein those parts identical to corresponding parts in the embodiments of FIGS. 1 through 7 are given identical reference numerals, and modified elements corresponding to previous elements are given the duplicate reference numerals raised by a factor of 100. The front and rear upper links 30 and 134 are both made as articulated members each having a variable effective length controlled by associated cam means to produce a compound anti-tilt and anti-vertical travel action. The front link cam control mechanism is essentially the same as that described previously in conjunction with FIGS. 1 through 7. However, in the modified embodiment of FIG. 8 the rear upper link 134 is also formed as an articulated two-piece member capable of having its effective length varied by a second cam control mechanism. The addition of this second cam control mechanism along with the articulation of the rear upper link is employed to modulate the tendency of the front mount 24 of the linkage to travel up and down during the projection and retraction stroke. In accordance with the invention, the design of the cam track controlling the floating pivot point in the articulated rear upper link 134 is such that the variation vertically of the front mount 24 out of a straight line path travel is reduced essentially to zero. Although it has been found that a significant reduction in such vertical travel variation or tolerance during extension or retraction is obtained by lengthening the links 30, 32, 134 and 36 relative to that shown in the aforementioned Ulinski U.S. Pat. No. 3,211,314, in accordance with the modified embodiment of the present invention shown in FIG. 8 a further reduction in vertical linkage travel can be obtained by introducing the second cam control mechanism and articulated rear upper links to obtain true straight line travel of the fork tips. The principles of design of the profile of the cam tracks for controlling both tilt and vertical movement of the front mount during extension or retraction are substantially the same as taught hereinbefore, as will be understood by those skilled in the art after studying the present disclosure.

Referring in more detail to FIG. 8, In this modified embodiment, the front lower arm 32 again has the cam plate 100 affixed to the upper surface thereof, and the upper front arm 30 is again articulated with the pivot point 82 between its end point pivots 50 and 66. However, the cam roller 96 tracking in a cam track 204 follows a modified plot contour derived by combining the linkage movement with articulation of rear link 134 controlled by a second cam plate 300 affixed to the upper surface of the rear lower arm 36. Cam track 304 is provided in cam plate 300 having a predetermined contour established by a similar plot layout or computer aided design program as set forth previously relative to cam track 104. Rear upper link 134 comprises a long link 306 extending from pivot 38 up to a second cam roller 310 having a pivot connection at 312 with a short link 314 which is pivoted at its upper end to pivot 64. Movement of pivot 312 is thus controlled by cam 300 to cause pivot 52 to move in true straight line path, i.e., horizontally with a vertical orientation of the lift truck uprights U. Cam profile 204 is designed in conjunction with cam profile 304 to control movement of pivot point 82 to again maintain parallalism of the imaginary line between pivots 50 and 52 in all positions thereof between retracted and extended position to thereby produce zero tilt of front mount 24. Reduced overall height is also obtained from the compound cam controlled front and rear variable length links 30 and 134.

From the foregoing description it will now be apparent that the invention and the embodiments as disclosed in the exemplary but preferred embodiments illustrated and described herein amply fulfill the aforestated objects of the invention as well as possessing several novel features and advantages over the prior art. In addition to providing a relatively low overall height, even when the load platform is retracted, the reach attachment linkage of the present. invention eliminates the noise and rattle of prior art scissor type linkages inasmuch as the only sliding or rolling member is cam roller 96 and-/or 310. Moreover, pivot 82 and/or 312 always remains under stress even in a retracted position and therefore anti-vibration contact is always maintained between pin 96 and/or 310 associated cam roller track. The disadvantages of fork tilt as well as vertical travel of the front mount up and down during extension and retraction of the aforementioned Ulinski U.S. Pat. No. 3,211,314 reach mechanism are also substantially reduced or eliminated. Moreover this is accomplished by a simple and strong mechanical pivot linkage and cam track structure which is inexpensive in construction and reliable in operation. The provision of the adjustable turn buckle-type upper front links 30 and 30' allows for final factory tune up and adjustment as well as field service re-adjustment to compensate for wear. Preferably lower front and rear links 32 and 36 are of box-type tubular construction to maximize strength and minimize weight.

In view of the foregoing description and drawings, as well as the objects and advantages as set forth hereinabove, it is believed that the principles of the present invention now will be well understood and that the contribution to the art set forth herein will be better appreciated. There are, of course, additional features of the present invention found in the aforementioned description, objects and drawings as well as in the appended claims which are the subject of the present invention. Those skilled in the art will appreciate that the conception on which the present disclosure is based may readily be utilized as a basis for designing other structures for carrying out the several purposes of the present invention. It is important, therefore, that the claims be regarded as including such equivalent constructions as do not depart from the spirit and scope of the present invention, in order to prevent appropriation of the present invention by those skilled in the art. For example, other means may be employed to vary in a predetermined manner the effective length of the front upper links 30 and/or the rear upper links 134, such as substituting a computer/mechanically/ or electrically controlled valve mechanism for controlling a ram interposed between the pivot point 82 and the associated arm 32, as well as to between pivot point 312 and the associated arm 36. Alternatively the effective length of the upper linkage arms may be varied by substituting hydraulic rams for the upper links which are controlled by a computer/mechanically/ or electrically controlled valve mechanism to extend and retract in a precise predetermined manner to accomplish the anti-tilt and anti-vertical travel features described above. However, such variations are deemed less preferable than the disclosed embodiments because of their extra cost and complexity and reduced reliability, as well as greater difficulty in providing service and repair in the field.

It is also to be understood that various terms of orientation, such as "front", "rear", "upper", "lower", etc. are used descriptively to facilitate understanding and not by way of limitation.

I claim:

1. A reach mechanism for use on a material handling device having a load support and a load carrier, said reach mechanism being of the type having a rear mount attachable to the device load support, a front mount for receiving and supporting the device load carrier, and extensible linkage means operably connected between said front and rear mounts for projection and retraction travel movement of said front mount relative to said rear mount through a generally linear and generally horizontal path of travel, said linkage means comprising two laterally spaced sets of links, each set having a first pair of upper and lower links pivoted at the lower ends thereof to said rear mount at spaced points and a second pair of upper and lower links pivoted at the lower ends thereof to said front mount at spaced points, means pivotably mounting the upper end of each of said first and second pair of upper links to the upper end of said second and first pair of lower links respectively, means pivotally connecting said lower links together at a point intermediate said upper and lower ends thereof and nearer to said upper ends of said lower links, and further having means for actuating said links to project and retract said front mount through said path of travel, the improvement wherein at least one of each of said first and second upper links of each set of links comprises at least two pieces connected for articulation between said upper and lower end pivots of said one upper link about a pivot connection intermediate said end pivots, and means for controlling movement of said intermediate pivot connection through a predetermined path which automatically varies the effective length of said one upper link to thereby provide stabilizing means operable during travel movement of said front mount between the projected and retracted positions thereof such that non-travel movement of said front mount comprising non-travel movement transverse to said path of travel and/or non-travel tilting movement of said front mount about an axis perpendicular to said path of travel is minimized during such projection and retraction travel movement of said front mount, said pivot movement controlling means comprising means operatively coupled between said intermediate pivot connection and an associated one of said lower links for causing a variation in the distance between said intermediate pivot connection and said one lower link to effect said controlled variation in the effective length of said one upper link, said operative coupling means comprising cam and cam follower means.

2. The improvement as set forth in claim 1 wherein said cam and cam follower means comprises a pair of laterally spaced cam track plates connected to said one lower link and each having a cam track opening therein, and said cam follower means comprises a roller spanning between said plates and extending at its opposite ends through said cam track openings, said one upper line comprising a short link pivotally coupled at its opposite ends to said roller pin and said upper end of the other one of said first and second upper links, an a longer link pivotally coupled at its opposite ends to said roller pin and the pivotal connection of said open upper link with the associated one of said rear and front mounts.

3. The improvement as set forth in claim 1 wherein each of said one upper links comprises said upper link having its lower end pivoted to said rear mount and said stabilizing means is constructed and arranged to primarily minimize said non-travel transverse movement of said front mount during travel movement thereof.

4. The improvement as set forth in claim 1 wherein each of said one upper links comprises said upper link having its lower end pivoted to said front mount and said stabilizing means comprises a first stabilizing means constructed and arranged to primarily minimize non-travel tilting movement of said front mount during said travel movement thereof.

5. The improvement as set forth in claim 4 wherein each of said rear upper links has a second stabilizing means operably coupled thereto and constructed and arranged to minimize said non-travel transverse movement of said front mount during said travel movement thereof, said first and second stabilizing means having a predetermined cooperative control over the effective lengths of said front and rear upper links such that the compound action thereof minimize both said transverse non-travel and non-travel tilt movement of said front mount during said travel movement thereof.

6. The improvement set forth in claim 1 wherein the other one of each of said first and second upper links has adjustment means to preset in a fixed the length thereof.

7. The improvement set forth in claim 1 said actuating means comprises power ram means coupled between said rear mount and said pivot connection of said lower links to project and retract said lower links to thereby project and retract said linkage means.

8. The improvement set forth in claim 2 wherein said cam track openings in said plates are contoured such that said roller pin follows a predetermined path correlated with a multiplicity of plot points taken from the position of said linkage means at predetermined intervals in said travel movement to thereby vary said effective length of said one upper link to thereby minimize said non-travel movement.

* * * * *